US009995034B2

(12) United States Patent
Rothenberg

(10) Patent No.: US 9,995,034 B2
(45) Date of Patent: Jun. 12, 2018

(54) PORTABLE TEMPORARY STRUCTURE

(71) Applicant: Yosef Rothenberg, Lakewood, NJ (US)

(72) Inventor: Yosef Rothenberg, Lakewood, NJ (US)

( * ) Notice: Subject to any disclaimer, the term of this patent is extended or adjusted under 35 U.S.C. 154(b) by 0 days. days.

(21) Appl. No.: 15/276,366

(22) Filed: Sep. 26, 2016

(65) Prior Publication Data

US 2017/0089061 A1 Mar. 30, 2017

Related U.S. Application Data

(60) Provisional application No. 62/232,342, filed on Sep. 24, 2015.

(51) Int. Cl.

| | |
|---|---|
| ***E04B 1/343*** | (2006.01) |
| ***E04H 1/12*** | (2006.01) |
| ***E04B 1/48*** | (2006.01) |
| ***E04B 1/61*** | (2006.01) |

(52) U.S. Cl.

CPC ..... *E04B 1/34384* (2013.01); *E04B 1/34321* (2013.01); *E04B 1/34326* (2013.01); *E04B 1/34331* (2013.01); *E04B 1/48* (2013.01); *E04B 1/54* (2013.01); *E04H 1/1205* (2013.01)

(58) Field of Classification Search

CPC ..... E04H 1/1205; E04H 1/02; E04B 1/34384; E04B 1/34326; E04B 1/34331; E04B 1/34321; E04B 1/48

USPC ..... 52/79.5

See application file for complete search history.

(56) References Cited

U.S. PATENT DOCUMENTS

| | | | | |
|---|---|---|---|---|
| 451,733 | A * | 5/1891 | Leonard | E04B 2/80 52/780 |
| 2,160,225 | A * | 5/1939 | Newman | E04B 1/6803 52/262 |
| 3,886,699 | A * | 6/1975 | Bergmann, Jr. | E04B 1/14 52/281 |
| 5,236,625 | A * | 8/1993 | Bardo | F28C 1/00 261/112.2 |
| 5,247,773 | A * | 9/1993 | Weir | E01F 8/0011 403/381 |
| 5,279,436 | A * | 1/1994 | Elliott | B65D 88/528 206/321 |
| 5,293,725 | A * | 3/1994 | Matticks | E04B 1/34315 52/126.1 |
| 6,550,216 | B1 * | 4/2003 | Ohanesian | E04C 2/20 52/537 |
| 2003/0009963 | A1 * | 1/2003 | Crowell | E04B 1/12 52/270 |
| 2004/0118061 | A1 * | 6/2004 | Little | E04B 2/7854 52/270 |
| 2005/0055969 | A1 * | 3/2005 | Simmons | E04B 1/24 52/831 |

FOREIGN PATENT DOCUMENTS

| | | | | |
|---|---|---|---|---|
| FR | 2524528 | A1 * | 10/1983 | E04B 1/14 |

* cited by examiner

*Primary Examiner* — Adriana Figueroa
(74) *Attorney, Agent, or Firm* — Amster, Rothstein & Ebenstein LLP

(57) ABSTRACT

A temporary room structure formed by a series of light-weight rails inserted between opposing posts. Each post has a one or more slots that run along the length of the post. The slots receive the ends of rails and maintain them in place. One or more metallic beams also are inserted between and connected to respective posts to add stability to the structure.

4 Claims, 11 Drawing Sheets

PORTABLE TEMPORARY STRUCTURE

RELATED APPLICATIONS

This application claims the benefit of pending U.S. Prov. Pat. Appl. Ser. No. 62/232,342 filed on Sep. 24, 2015—the contents of which are incorporated by reference herein.

FIELD OF THE INVENTION

The current invention relates to the field of temporary structures, more specifically, to a collapsible and portable structure.

BACKGROUND OF THE INVENTION

There is often a need for a temporary structure for holding outdoor activities or for storage purposes. Observers of the holiday of Sukkot (Feast of Tabernacles) hold their meals and other social activities within the confines of temporary outdoor structures or booths. There is, thus, a need for a system for quickly erecting a structure without the need for any tools.

SUMMARY OF THE INVENTION

Accordingly, it is an object of the invention to provide a temporary room structure that is formed of a series of rails or planks that insert between two opposing posts. A plurality of contiguous rails form a wall. One or more metallic beams are inserted between two opposing posts in each wall to provide structural enforcement. The structure is composed of lightweight and storage-friendly parts and requires no tools or mechanical expertise to erect.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION OF THE INVENTION

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

The invention relates to a temporary structure formed of vertical posts that are positioned to maintain a series of horizontal rails therebetween.

Figure 1:
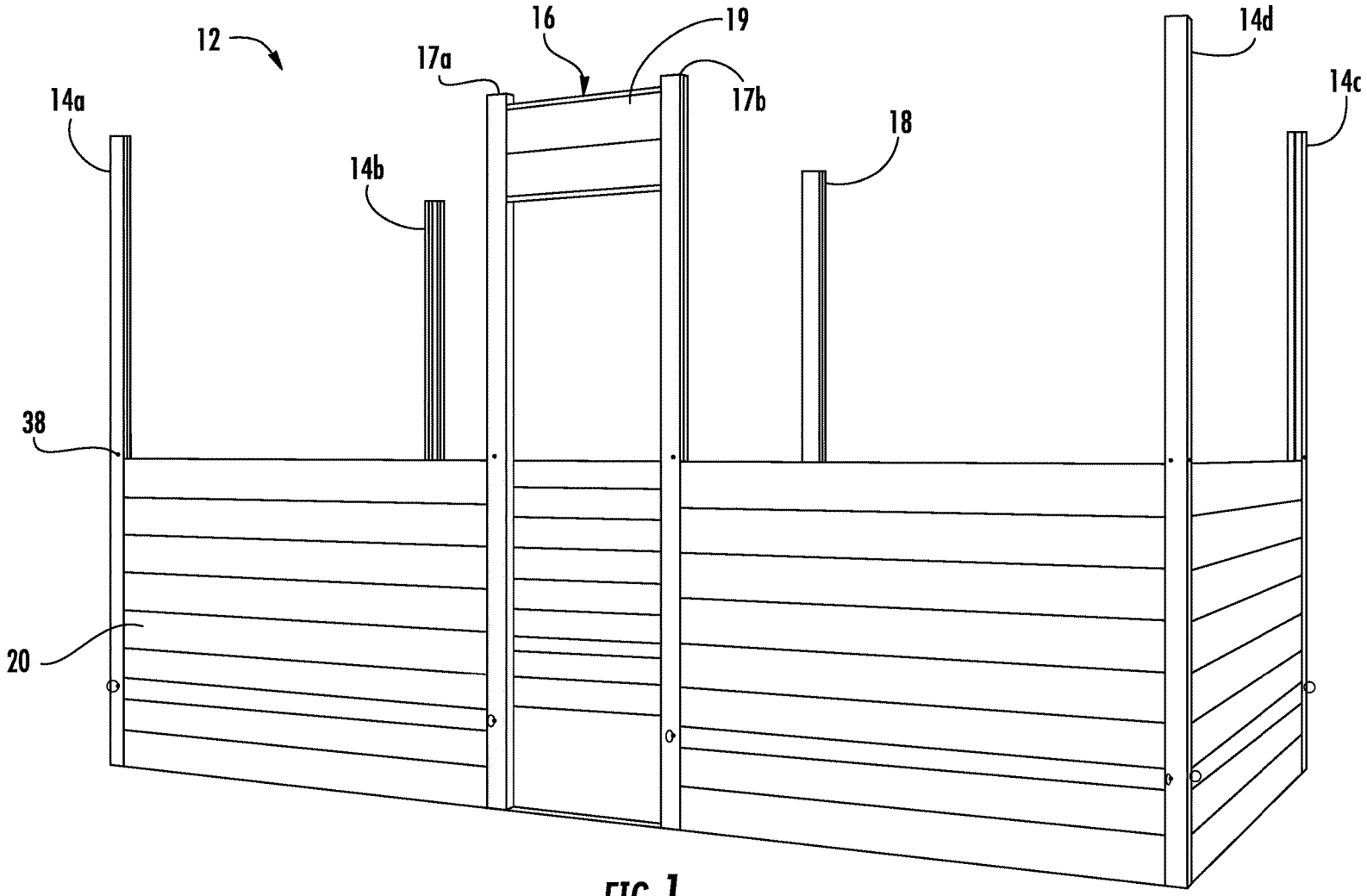
FIG. 1 is front perspective view of a partially built temporary structure according to an embodiment of the invention.

FIG. 1 shows a front perspective view of a partially assembled temporary structure according to an embodiment of the invention. In the exemplary embodiment shown, the structure is formed of four corner post 14*a*, 14*b*, 14*c* and 14*d* positioned at each corner. The front wall has a door frame 16 disposed substantially between corner posts 14*a* and 14*d*. The rear wall has a center post 18 disposed substantially between corner posts 14*b* and 14*c*.

Corner posts 14*a*, 14*b*, 14*c* and 14*d*, center post 18, and door frame 16 each are configured to stand substantially vertically and they each have at least an elongated longitudinal slot that is sized and shaped to receive the ends of horizontally oriented rails 20.

Figure 2:
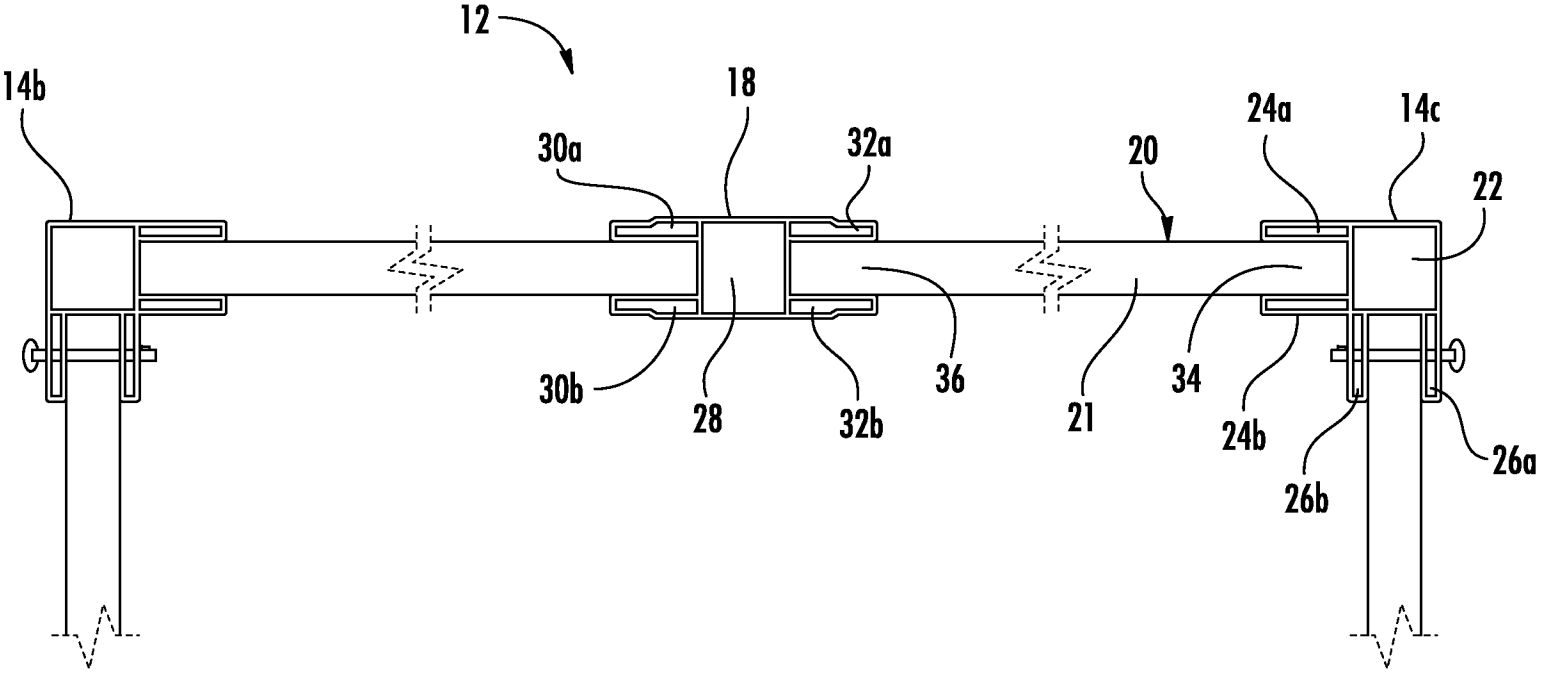
FIG. 2 is a partial top cross-sectional view of an assembled temporary structure according to an embodiment of the invention.

Referring to FIG. 2, which is a partial top cross-sectional view of a temporary structure 12, corner posts 14*b* and 14*c* are shown with a center post 18 positioned therebetween. Corner posts (e.g. 14*c*) are formed of a block 22 that is substantially square in cross-section and which has two slots projecting laterally from two sides thereof. For example, as shown, a first slot is formed of walls 24*a*, 24*b* and a second slot is formed of walls 26*a*, 26*b*. The first slot and second slot are positioned substantially orthogonally to each other. Center post 18 also is formed of an inner support beam 28 that is substantially square in cross-section with two opposing slots projecting from opposite sides thereof. For example, walls 30*a*, 30*b* form a first slot, whereas walls 32*a*, 32*b* form a second slot. It will be understood that inner support beam of posts (e.g. 22, 28) may comprise a solid block, however, in embodiments of the invention, they are formed walls that surround a hollow interior (as shown) allowing the posts to remain lightweight. Inner support beams (e.g. areas from which slots projects) are elongated structural supports members that provide posts with rigidity. In embodiments of the invention, one or more slots run along the entire length of inner support beam.

Figure 10:
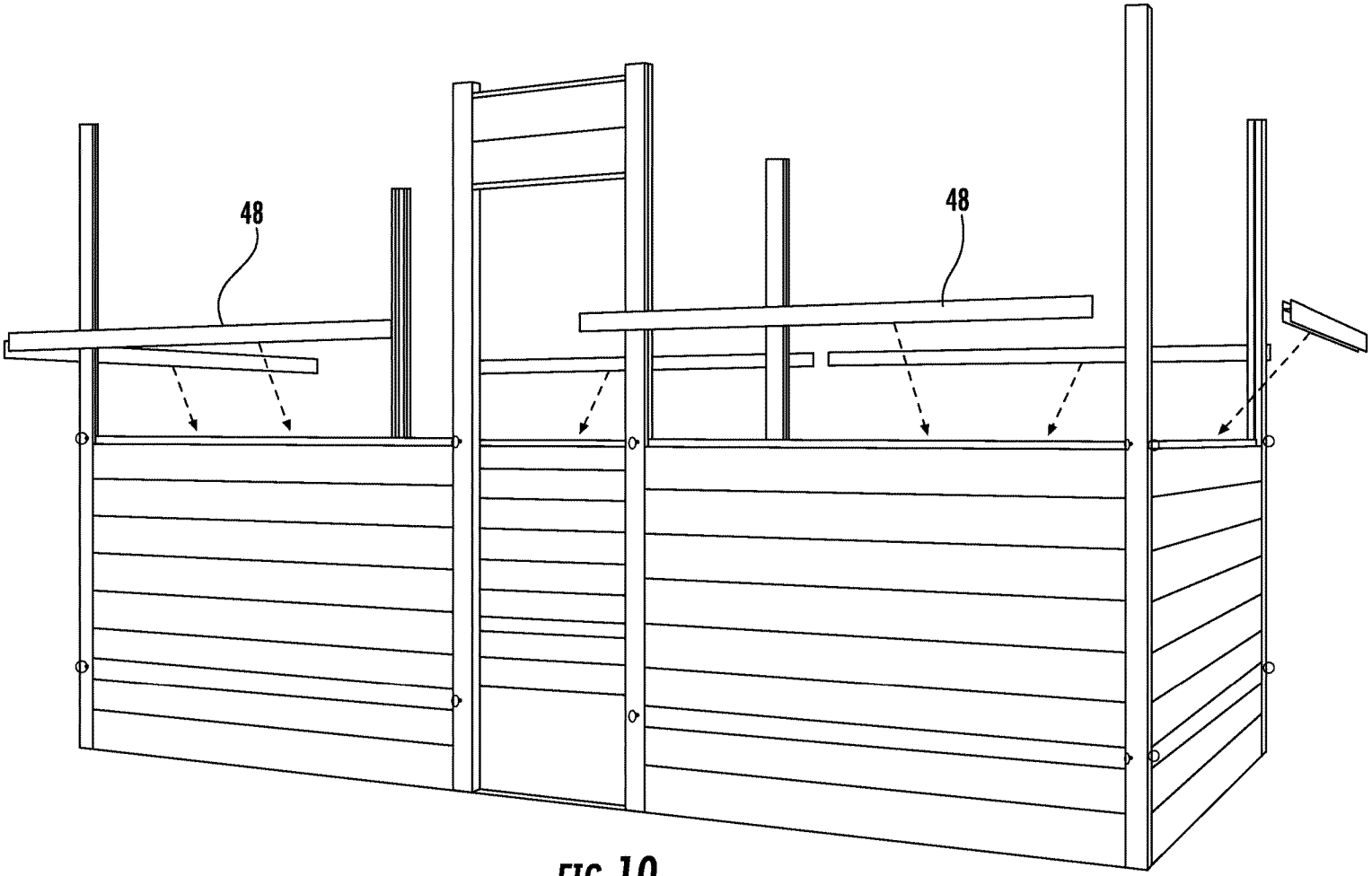
FIG. 10 is a front perspective view of a partially built temporary structure schematically showing installation of decorative rails over metallic beams according to an embodiment of the invention.

FIG. 2 shows a top view of a rail 20 secured in respective slots formed by respective posts. Rails 20 that are configured to form walls for the temporary structure 12 each have a top surface 21, a bottom surface a right side surface (right side surface denoted as "23" in FIGS. 5A, 5B) and a left side surface. The top surface 21 of rails 20 are shown in FIG. 10.

In embodiments of the invention, respective posts are oriented substantially vertically and positioned such that a slot of a first post faces a slot of second post. For example, corner post 14*c* is shown with its first slot facing the second slot of center post 18. Posts 14*c* and 18 are positioned at a distance to respectively receive a first end 34 of rail 20 in the first slot of corner post 14*c* and a second end 36 of rail 20 in the second slot of center post 18.

Figure 5A:
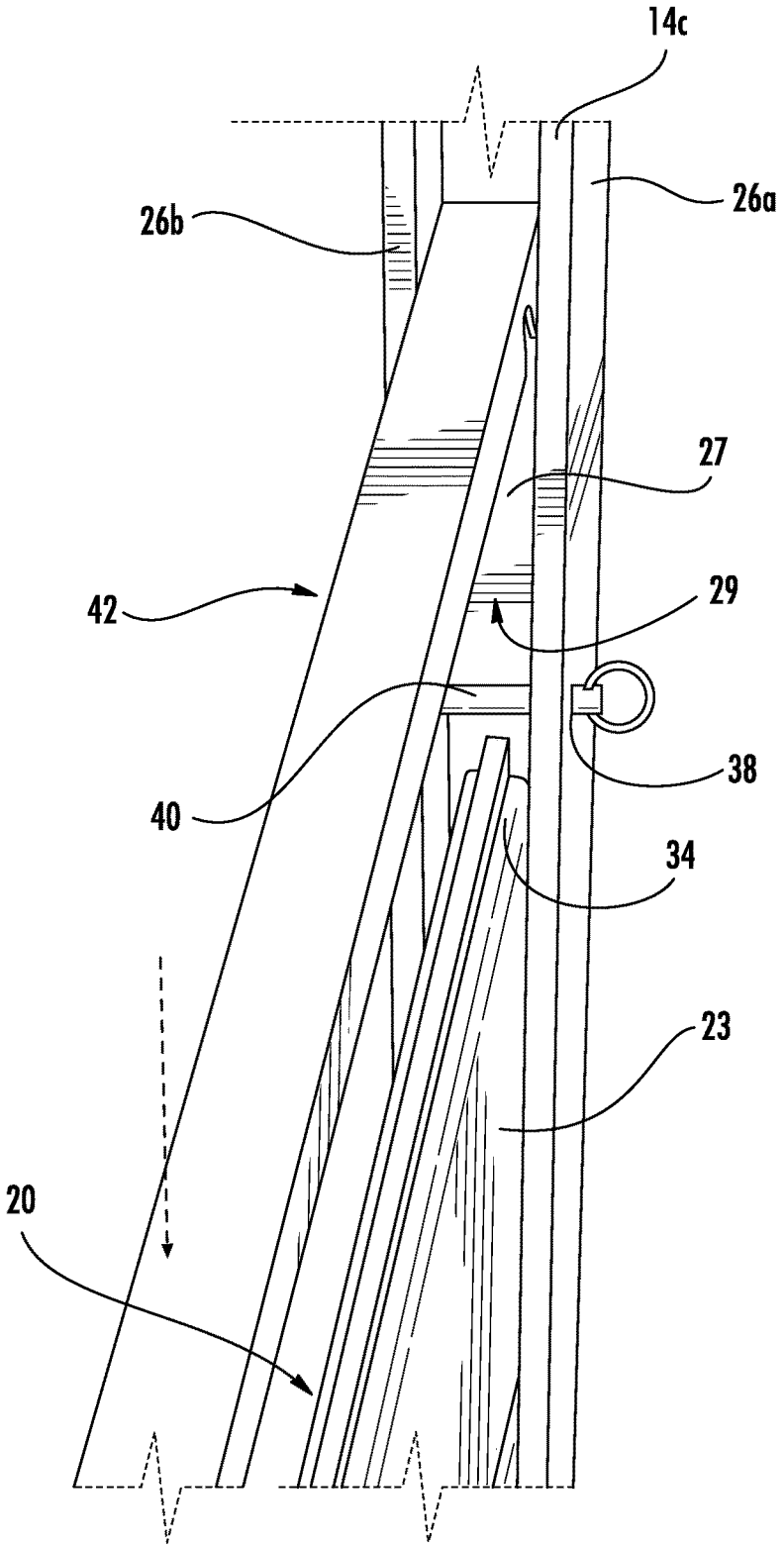
FIG. 5A is a side perspective view of a metallic beam positioned for insertion onto a cooperating pin according to an embodiment of the invention.
Figure 5B:
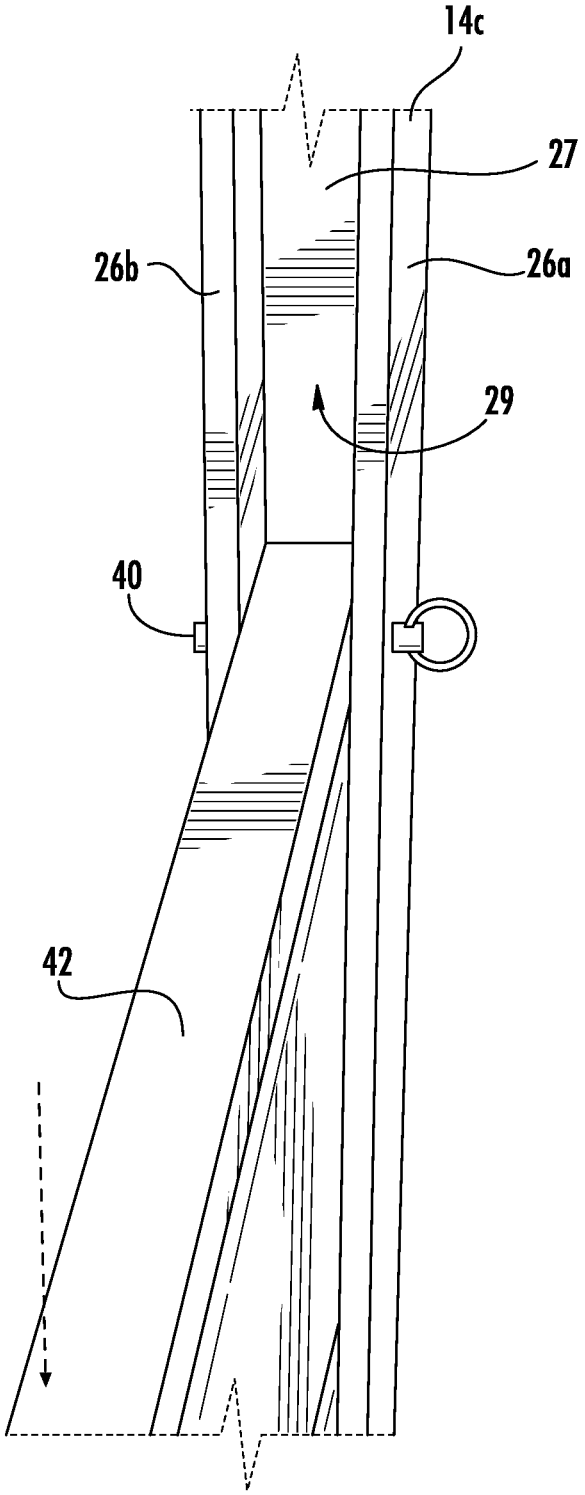
FIG. 5B is a side perspective view of a the metallic beam of FIG. 5A seated on a pin according to an embodiment of the invention.

As best shown in FIGS. 5A, 5B, each slot on respective posts is formed of two substantially parallel walls (e.g. 26*a*, 26*b*) and a rear wall 32. Side walls 26*a*, 26*b*, and rear walls 32 extend longitudinally along the height of post—forming an elongated slot 29 defined by the space surrounded by the inside surfaces of walls 26*a*, 26*b*, and rear wall 32. Slot 29 is sized and shaped to receive a series of ends of rails 20. For example, as shown, first end 34 of rail 20 inserts into slot 29 such that the right surface 23 thereof contacts the inner surface of sidewall 26*a*, and the left side surface of rail 20 (not shown) contacts the inner surface of sidewall 26*b*. The end of rail abuts against rear wall 27. The second end 36 of rail 20 is similarly inserted into a second slot formed by walls 32*a*, 32*b* (and a rear wall) of post 18. The distance between inner walls (e.g. 26*a*, 26*b*) of slots (e.g. 29) is incrementally greater than the thickness of rail 20. As such, inner walls of slots respectively contact the outside surfaces of rail ends (e.g. 34, 36). When rails 20 are inserted between posts, slots prevent lateral movement of the same and rails 20 are substantially maintained in place.

It will be understood by those of ordinary skill in the art that posts may be formed in any of various configurations. For example, in addition to corner posts which are provided with slots at substantial right angles and center posts which have opposing substantially coplanar slots, different configurations are possible in embodiments of the invention. For example, posts may be formed in "T" shaped profile whereby three slots are provided (e.g. two opposing slots and one disposed substantially orthogonally thereto).

In embodiments of the invention, and as shown in FIG. 1, a door frame 16 may be configured as a post for receiving rails 20. For example, door frame 16 is formed of two posts 17*a*, 17*b* that are bridged by a header or lintel 19. Post 17*a* has a slot that opens in a one direction (e.g. left in the orientation shown) and post 17*b* has a slot that opens in a substantially opposite direction (e.g. right in the orientation shown). As shown, rails 20 are maintained between the first slot of corner post 14*a* and the slot of post 17*a*. Rails are similarly maintained between the slot of post 17*b* and the first slot of corner post 14*d*.

In a preferred embodiment, rails and posts are formed of lightweight plastic, PVC or such similar rigid, yet light material. In other embodiment, rails and posts may be formed of any of various materials including aluminum, steel, or even wood.

In use, a user inserts a series of rails 20 between posts to form a wall of a temporary structure. Corner posts 14*a*, 14*b*, 14*c* and 14*d* are placed at each corner and rails 20 are inserted into the respective slots of the corner posts. A user may insert one or more central posts 18 to extend the length of a wall.

In the exemplary embodiment shown in FIG. 1, a front wall of structure 12 is provided with a door frame 16 disposed substantially midway between corner posts 14*a* and 14*d* and a rear wall is provided with a center post 18 disposed substantially midway between corner posts 14*b* and 14*c*. It will be understood that rails 20 may be provided at various lengths for use with various structure configurations. For example, rails 20 used on rear wall are greater in length than those used on the front wall. That is because, the distance between corner posts 14*b*, 14*c* and center post 18 is greater than the distance between corner posts 14*a*, 14*d* and posts 17*a*, 17*b* of door frame 16.

In embodiments of the invention, respective posts are secured to one another via one or more metallic beams disposed between the posts. The metallic beam also provides structural support. Referring to FIG. 1, holes (e.g. 38) are provided on posts to receive a pin, bolt or similar cylindrical structure that is configured to receive a cooperating metallic beam.

Figure 3:
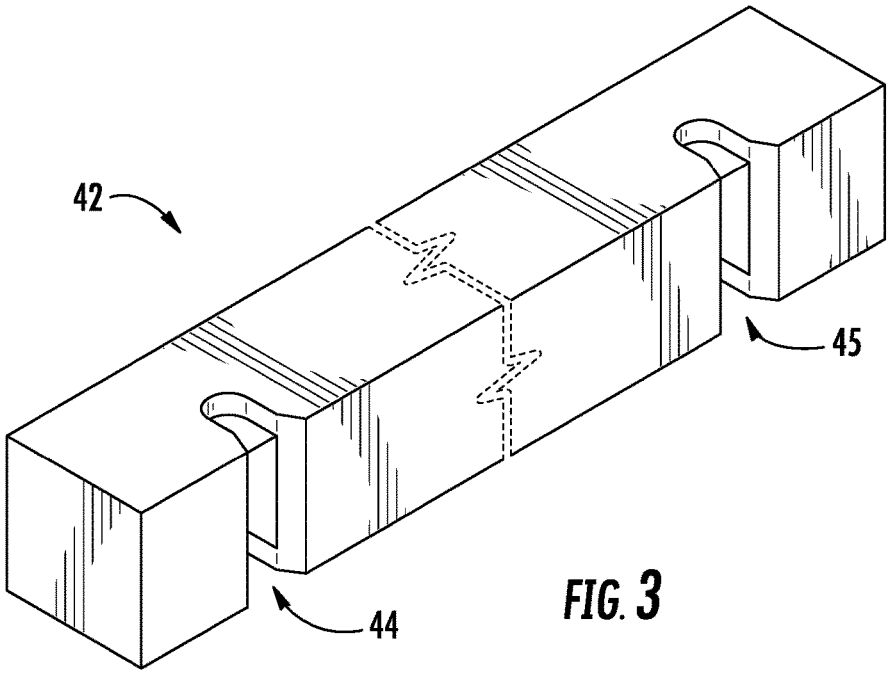
FIG. 3 is a bottom perspective view of a metallic beam, shown truncated, according to an embodiment of the invention.
Figure 4:
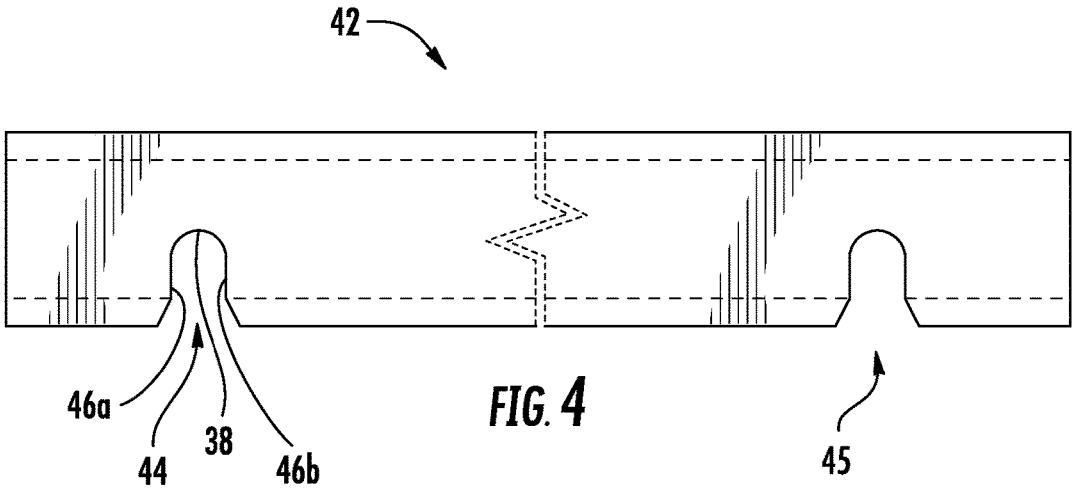
FIG. 4 is a side view of a metallic beam, shown truncated, according to an embodiment of the invention.

FIG. 3 shows a bottom perspective view of a metallic beam 42 according to an embodiment of the invention, whereas, FIG. 4 shows a side view thereof. As shown two notch outs 44, 45 are made in the bottom surface of the two terminal ends of beam 42. As shown, each notch-out 44, 45 has two substantially parallel walls 46*a*, 46*b* and a rounded upper wall 48 which bridges walls 46*a*, 46*b*. A rounded pocket formed by walls 46*a*, 46*b*, and 48 is substantially sized and shaped to receive an outside shaft of a cylindrical pin inserted into hole 38.

FIGS. 5A and 5B show perspective side views of a post (e.g. 14*c*) and the stepwise installation of a metallic beam 42 according to embodiments of the invention. A first hole 38 is made in side wall 26*a* and a second hole is made in wall 26*b* (hole not shown). First hole 38 on wall 26*a* and second hole on wall 26*b* are substantially the same size and shape, and are disposed substantially parallel to one another.

In use, a user installs a pin 40 through respective holes on side walls 26*a*, 26*b*. Pin 40 is sized and shaped to receive a notch (e.g. 45) provided on the underside of a metallic beam 42. Referring to FIG. 5A, a user positions metallic beam 42 with notches 44, 45 facing downward and lowers the beam 42 such that shafts of pin 40 inserts into notch (e.g. 45). FIG. 5B shows beam 42 with its notches fully seated on respective pins. Thus, metallic beam 42 connects one post to a second post. That is, because metallic beam 42 is anchored on each side (via notches inserted into pins) to separate posts—it serves as secure connection between posts.

It will be understood that metallic beam 42 may be formed of any of various metallic materials, such as steel, aluminum, alloys or such similar materials. Alternatively, beam 42 may be formed of any rigid material such as hard plastic or the like.

Figure 6:
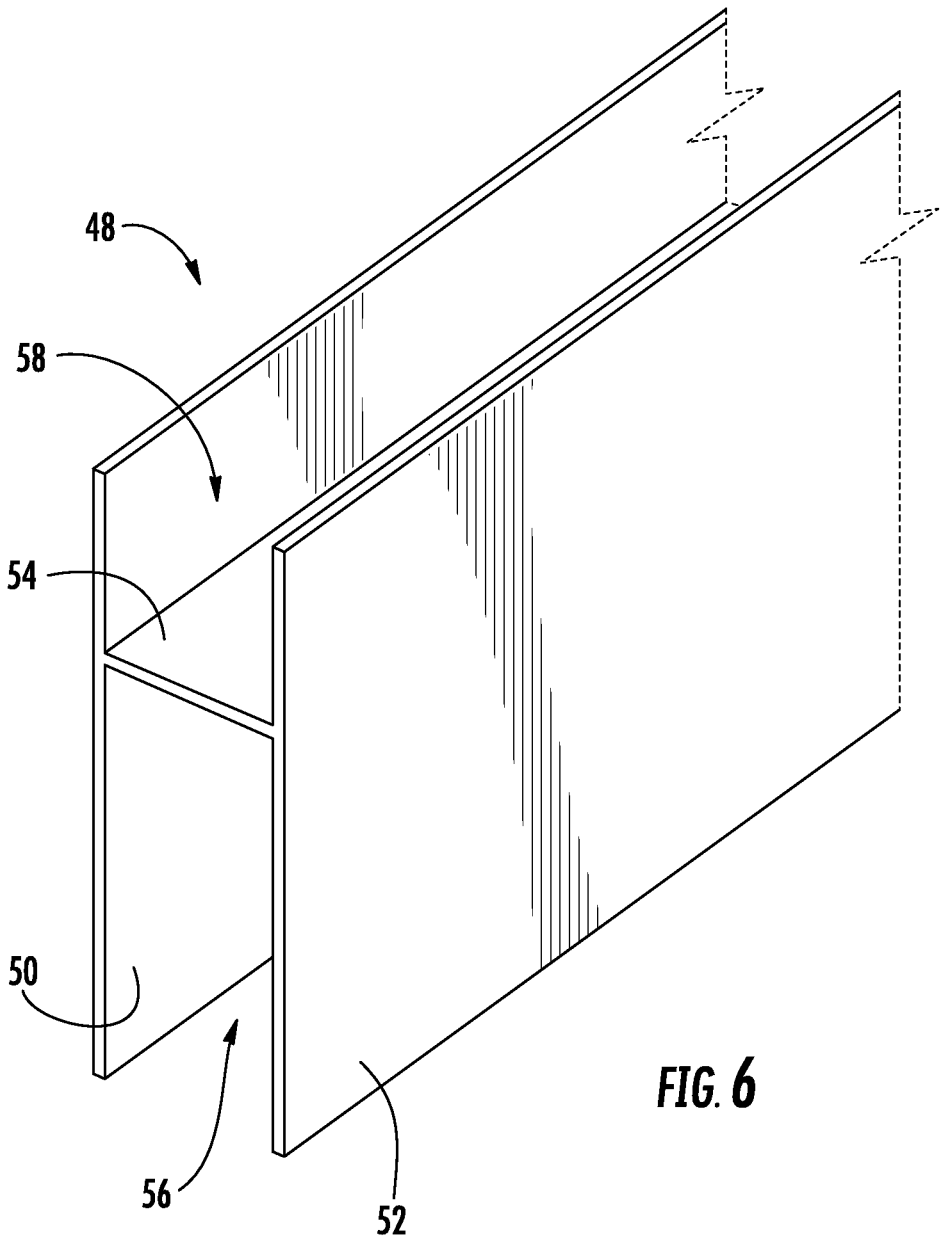
FIG. 6 is a side perspective view of a decorative rail configured to cover a metallic beam according to an embodiment of the invention.

FIG. 6 shows a decorative rail 48 that is designed to cover metallic beam 42. Decorative rail 48 is substantially "H-shaped" in profile. As shown, a first wall 50 that is substantially parallel to a second wall 52 is bridged by joining wall 54. A lower pocket 56 formed by walls 50, 52 and underside of joining wall 54 inserts over metallic beam 42—thereby covering it with a material (such as PVC) that is consistent with rails 20. Upper pocket 58, formed by walls 50, 52 and upper surface of joining wall 54, receives the bottom surface of a subsequently applied rail 20.

Figure 7:
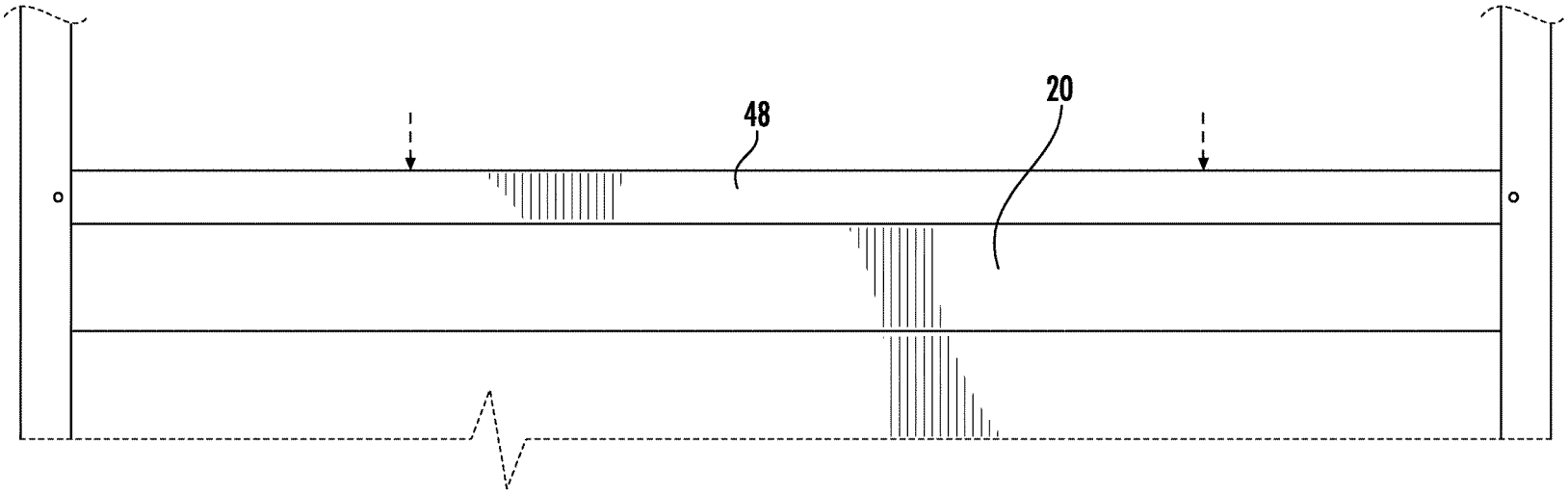
FIG. 7 is a side partial view of a wall section showing the decorative rail of FIG. 6 installed to cover a metallic beam according to an embodiment of the invention.

FIG. 7 schematically shows a decorative rail 48 lowered over and obscuring a metallic beam. Thus, an observer sees only an outside surface of a rail 20 and a decorative rail 48—and not the metallic beam 42.

Figure 8:
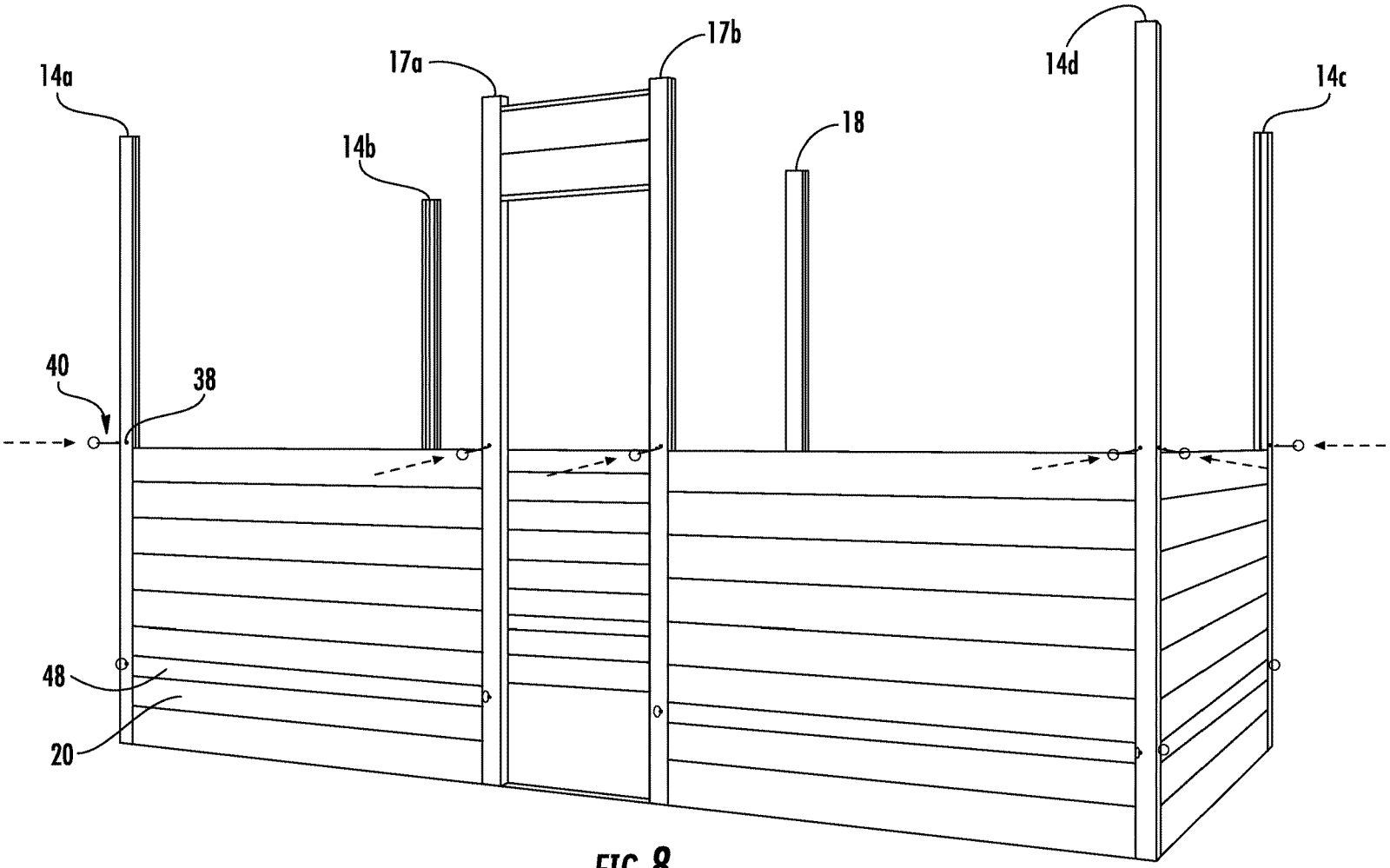
FIG. 8 is front perspective view of a partially built temporary structure schematically showing insertion of pins according to an embodiment of the invention.
Figure 9:
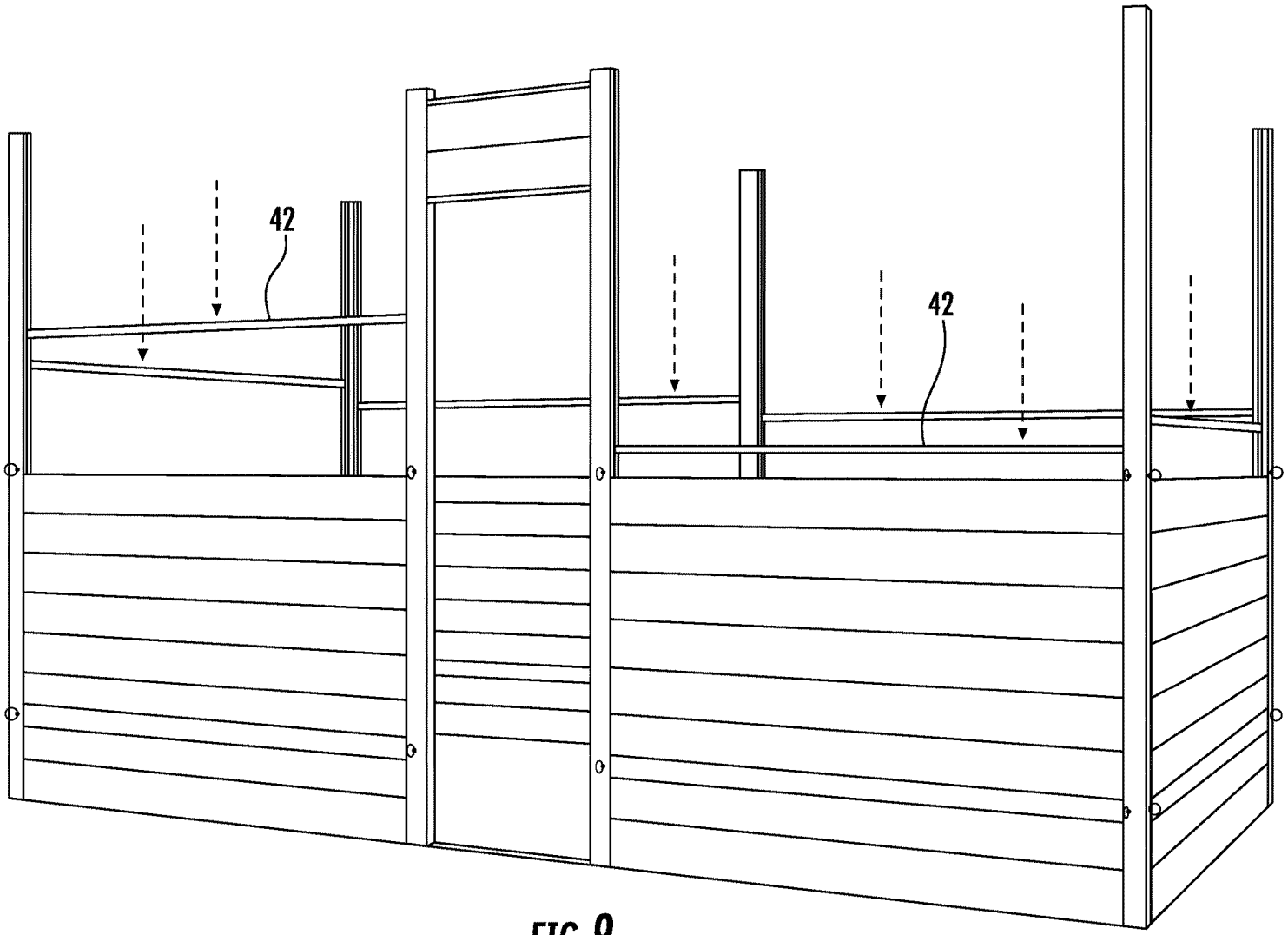
FIG. 9 is front perspective view of a partially built temporary structure schematically showing installation of metallic beams according to an embodiment of the invention.

Referring to FIG. 1, a series of rails are shown abutting one another to form substantially half a wall height. In use, a user begins by installing a first rail between two posts and then inserts a second one where the bottom surface of the second rail rests on the top surface of a previous one. At certain intervals (e.g. after installation of specified numbers of rails) a metallic beam is installed with a decorative rail placed thereover. A user may continue to insert rails on top of the decorative rail. It will be understood that a user may install rails 20 in seriatim until a desired wall height is achieved FIG. 8-10 show schematic stepwise illustrations of the installation of a metallic beam which is used to provide structural integrity. As shown, in FIG. 8, a user inserts pins 40 through provided holes in posts (e.g. 38). As shown, a pin 40 is inserted through parallel holes made in side walls of corner posts 14*a*, 14*b*, 14*c*, and 14*d*. A user similarly inserts pins 40 through corresponding holes through side walls of slots of posts 17*a*, 17*b* and center post 18. Thereafter, and as shown in FIG. 9, a user lowers a metallic beam 42 onto respective pins. As shown in FIG. 10, once the metallic beam 42 is secured, a user applies a decorative rail 48 to hide the metallic beam 42.

FIGS. 8-10 show two metallic bars provided on each wall segment ("wall segment" refers to a series of rails 20 that form a wall capped by posts on each end thereof), however, more or less than two metallic beams per wall segment are possible in different embodiments of the invention.

It will be understood that embodiments of the invention allow users to build any of various wall or room-type structures. Moreover, in addition to door frame 16 and center post 18, a user may install windows or the like. For example, a window is provided having a frame, whereby the two outer frame members have opposing slots for receiving rails 20.

In embodiments of the invention, a user may select a particular wall height based on the number of rails installed. That is, as set forth, wall segments are formed by a number of rails 20 installed one atop another in between two opposing slots associated with posts. A user may choose to insert a number of rails 20 sufficient to build a wall segment that is substantially half the height of posts (e.g. as shown in FIG. 1). A user, on the other hand, may choose to insert a sufficient number of rails 20 to build walls or wall segments that are substantially the same height of posts by installing a sufficient number of rails 20 to occupy substantially the entire area of slots associated with posts.

Figure 11:
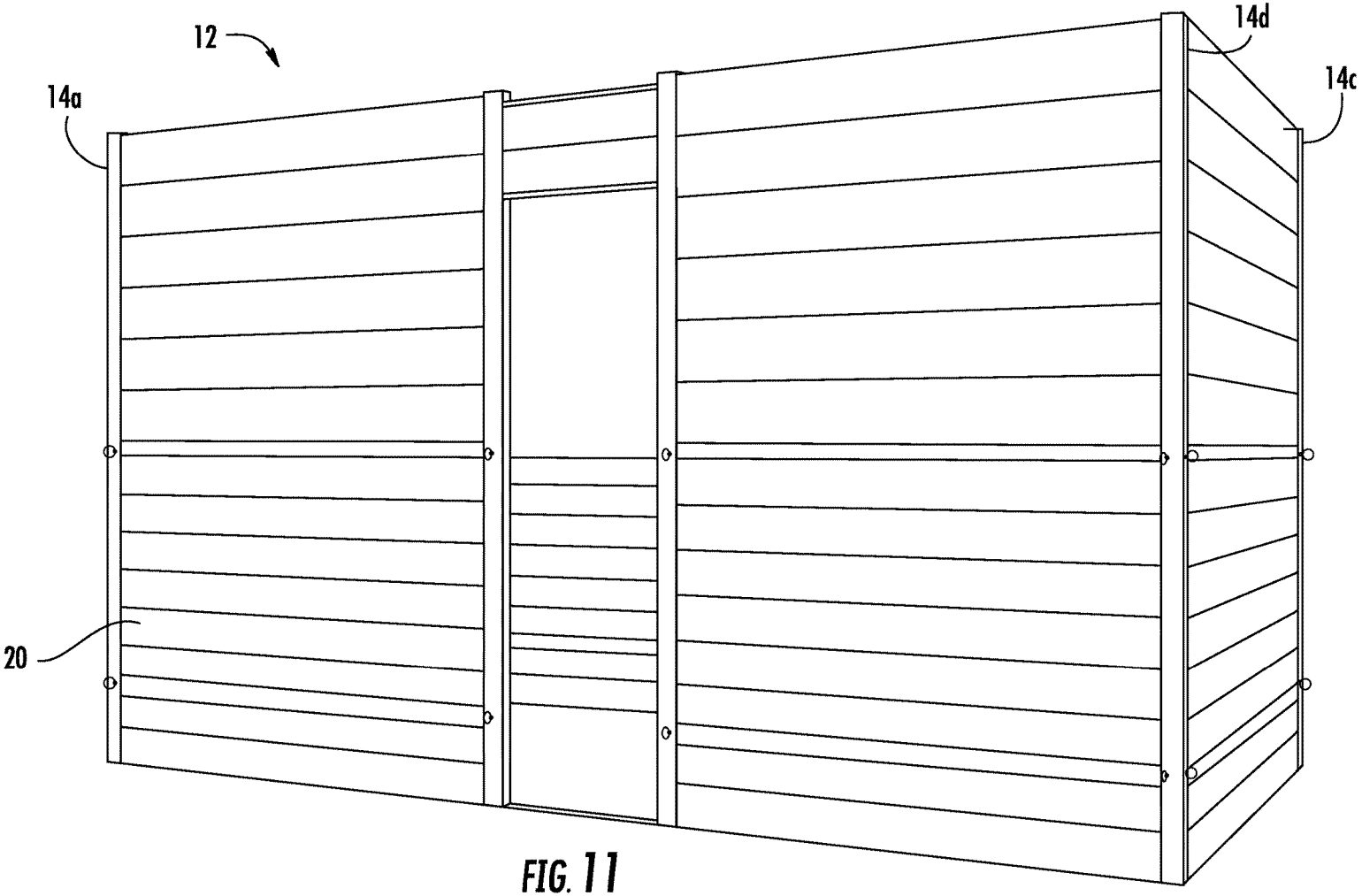
FIG. 11 is a front perspective view of the temporary structure of FIG. 10 showing wall segments having rails along the entire length of posts according to an embodiment of the invention.

For example, FIG. 11 shows a booth formed according to embodiments of the invention. The booth is has a front wall, a rear wall, and two sidewalls formed of rails 20 inserted between posts. As shown, front wall and right side wall are formed by inserting rails 20 along the respective lengths of posts 14*a* and 14*d*.

Having described this invention with regard to specific embodiments, it is to be understood that the description is not meant as a limitation since further modifications and variations may be apparent or may suggest themselves to those skilled in the art. It is intended that the present application cover all such modifications and variations.

What is claimed is:

1. A temporary structure, comprising:

a first post having an inner beam having a height and width and a slot projecting from the inner beam, the slot comprising two substantially parallel walls bridged by a rear wall, the two parallel walls further comprising holes through the parallel walls that, are substantially parallel to one another;

a pin inserted into the holes on the first post;

a second post having an inner beam having a height and width and a slot projecting from the inner beam, the slot comprising two substantially parallel walls bridged by a substantially parallel to one another;

a pin inserted into the holes on the second post;

a door frame comprising a first door frame post and a second door frame post, whereby the first door frame post is bridged to the second door frame post by a lintel, the first door frame post comprising a slot facing a first direction, the slot comprising two substantially parallel walls bridged by a rear wall, the two parallel walls further comprising holes through the parallel walls that are substantially parallel to one another, the second door frame post comprising a second slot facing a second direction, the second slot comprising two substantially parallel walls bridged by a rear wall, the two parallel walls further comprising holes through the parallel walls that are substantially parallel to one another;

a pin inserted into the holes in the slot on the first door frame post and a pin inserted into the holes in the slot on the second door frame post;

the first post positioned at a first distance from the door frame;

whereby the slot of the first post faces the slot of the first door frame post;

the second post positioned at a second distance from the door frame;

whereby the slot of the second post faces the slot of the second door frame post;

a beam having a first end and a second, the first end comprising a first notch out, and the second end comprising a second notch out, the first notch out and the second notch out seated on respective pins inserted into respective slots in the first post and the first door frame post;

a first series of rails, whereby each rail in the first series of rails comprises a first end, a second end, a top surface, a bottom surface, a right surface and a left surface;

whereby the first ends of the rails of the first series of rails insert into a slot of the first post and the second ends of the rails of the first series of rails insert into a slot on the first door frame post.

2. The temporary structure of claim 1, whereby the beam comprises metallic material and the first and second series of rails comprise plastic material.

3. The temporary structure of claim 1, further comprising a decorative rail covering the beam.

4. A temporary structure, comprising:

a first post having an inner beam having a height and width and a slot projecting from the inner beam;

a second post having an inner beam having a height and width and a slot projecting from the inner beam;

the first post positioned at a first distance from the second post, whereby the slot of the first post faces the slot of the second post;

a first series of rails, whereby one or more rails, each rail in the first series of rails comprises a first end, a second end, a top surface, a bottom surface, a right surface and a left surface;

whereby the first ends of the one or more rails of the first series of rails are configured to insert into a slot of the first post and the second ends of the rails of the first series of rails are configured to insert into a slot on the second post;

the slot of the first post comprising a pin disposed therein and the slot of the second post comprising a pin disposed therein;

a beam having a first terminal end and a second terminal end and a first notch out and a second notch out, the first terminal end configured to insert into the slot on the first post and the first notch out configured to be seated on the pin of the first slot, the second terminal end configured to insert into the slot on the second post and the second notch out configured to be seated on the pin of the second slot.

* * * * *